US005706560A

United States Patent [19]

Anscher et al.

[11] Patent Number: 5,706,560

[45] Date of Patent: Jan. 13, 1998

[54] CLIP FOR RELEASABLY SECURING OBJECTS

[75] Inventors: Joseph Anscher, Muttontown, N.Y.; Doug Murdoch, Santa Rosa, Calif.

[73] Assignee: National Molding Corp., Farmingdale, N.Y.

[21] Appl. No.: 767,915

[22] Filed: Dec. 17, 1996

[51] Int. Cl.[6] ..... A44B 21/00; A44B 11/00; B65D 77/10

[52] U.S. Cl. ..... 24/543; 24/30.5 P; 24/30.5 R

[58] Field of Search ..... 24/543, 542, 530, 24/487, 30.5 R, 30.5 P, 16 PB, 198

[56] References Cited

U.S. PATENT DOCUMENTS

| | | | |
|---|---|---|---|
| 2,551,019 | 5/1951 | La Pierre | 24/543 |
| 3,461,876 | 8/1969 | Miller, Jr. | 24/543 X |
| 3,823,443 | 7/1974 | Takabayashi | 24/543 X |
| 3,824,654 | 7/1974 | Takabayashi | 24/543 X |
| 3,978,555 | 9/1976 | Weisenthal | 24/543 |
| 4,038,726 | 8/1977 | Takabayashi | 24/543 X |
| 4,296,529 | 10/1981 | Brown | 24/30.5 P |
| 4,866,818 | 9/1989 | Thompson | 24/543 |
| 4,991,267 | 2/1991 | Appersonm et al. | 24/30.5 R |
| 5,123,146 | 6/1992 | Olsen | 24/30.5 P X |
| 5,423,831 | 6/1995 | Antes | 24/543 X |
| 5,428,871 | 7/1995 | Iosif | 24/543 X |
| 5,598,608 | 2/1997 | Naslund | 24/30.5 R |

*Primary Examiner*—Peter M. Cuomo
*Assistant Examiner*—Robert J. Sandy
*Attorney, Agent, or Firm*—Collard & Roe, P.C.

[57] ABSTRACT

An integrally-formed clip for releasably securing objects, comprising a clip body and at least one free arm attached at one end to the clip body. The free arm is positioned at an angle away from the clip body such as to create an opening between the second end of the free arm and the clip body. A latch is disposed on the second end of the free arm and has a free end extending toward the clip body at an angle. A tooth is disposed on the free end of the latch, positioned generally parallel to the free arm. There is at least one groove having dimensions substantially equal to those of the tooth arranged on the end of the clip body nearest the second end of the free arm. Downward pressure on the latch causes the tooth to be engaged by the groove and lock the second end of the free arm to the clip body. Upward pressure on the latch causes the tooth to become disengaged from the groove and release the second end of the free arm. Upward pressure on the free arm while in the locked position causes the tooth to be pressed into the groove with increasing force and lock the free arm more securely onto the clip body.

10 Claims, 6 Drawing Sheets

CLIP FOR RELEASABLY SECURING OBJECTS

BACKGROUND OF THE INVENTION

1. Field of the Invention

This invention relates to a multi-purpose clip for releasably securing devices on backpacks, luggage and clothing. More specifically, this invention relates to an integrally-formed clip having an arm that can be releasably locked closed into the clip for securing devices.

2. The Prior Art

Clips and buckles for securing devices to clothing and luggage are known. However, in conventional clips made from lightweight, flexible materials, the clips are not adapted to withstand large amounts of stress without either releasing or breaking. Previously known clips that are sufficient to withstand high levels of stress have been made out of heavy, expensive materials, such as steel or brass, which are also highly visible. The use of heavy metal clips on backpacks increases the weight of the pack as well as detracting from its aesthetic appearance.

SUMMARY OF THE INVENTION

It is therefore an object of the present invention to overcome the drawbacks of the prior art and to provide a clip wherein objects and devices can be releasably secured to each other. It is another object of the present invention to provide a clip that is lightweight, easy to manufacture and aesthetically pleasing, yet capable of securing heavy objects and withstanding high stresses without breaking or releasing the objects. It is a further object of the present invention to provide a clip wherein the higher the stress placed on the clip, the tighter the clip is locked closed.

These and other objects are achieved by an integrally-formed clip having at least one arm releasably secured at one end to the clip body by a releasable locking means. The free arm is permanently attached at one end to a first end of the clip body and extends away from the clip body at an angle.

The second end of the free arm is releasably secured to a second end of the clip body via a locking means. The locking means comprises a latch attached to the second end of the free arm and extending at an angle toward the clip body. The free end of the latch has a tooth extending in a direction generally parallel to the free arm.

The end of the clip body to be engaged by the second end of the free arm contains a groove having similar dimensions to the tooth, for releasably securing the tooth in the groove. The clip may be closed by exerting downward pressure on the free arm, causing the tooth to be engaged by the groove. A release of the downward pressure leaves the tooth still engaged by the groove. The clip may be opened by sufficient upward pressure on the latch so that the tooth becomes disengaged by the groove.

In the locked position, the clip is adapted such that as the upward pressure on the free arm increases, such as by a strap that is secured to the clip and pulled away, the tooth becomes more tightly engaged within the groove. The locking power of the tooth/groove interaction increases as the stress on the free arm increases, up to a stress of 50 lbs.

The clip body may be comprised of a plurality of spaced apart, elongated arms arranged parallel to one another and connected at both ends to each other. The spaced-apart, permanently closed arms of the clip body serve to permanently mount the clip to an article of clothing, a backpack, luggage or other article. The clip may be permanently mounted by sewing a strap through the spaced-apart arms or by any conventionally known means for attaching clips and buckles to objects.

In a preferred embodiment, the tooth and the groove are disposed across only a portion of the width of the clip. This enables the clip to be easily manufactured by injection molding. The position of the tooth and groove across only one portion of the clip body enables the efficient production of the injection molds and thus makes the clip manufacturing process easier and less expensive.

The clip is preferably made from acetal, a synthetic type of plastic that lends exceptional strength and durability to the clip while remaining sufficiently flexible to operate the locking means.

The clip may be manufactured so that there are two free arms, one arm extending along each side of the clip body, so that two different objects or devices can be releasably secured on one clip. In this configuration, it is preferable to have the two locking mechanisms located on opposite ends of the clip body.

In another embodiment, the clip can be integrally formed with a variety of devices and attachments such as D-rings, buckles, key rings, hooks, or any other suitable attachment.

In yet another embodiment, instead of a tooth in the latch and a groove in the clip body, the free arm of the clip may secured by a bore extending through the latch, and an outwardly-extending plug on the clip body. The plug is wider at the end than at the base. Downward pressure on the latch causes the plug to insert into the bore and stay securely fastened until upward pressure on the latch releases the plug. The bore has a diameter that is equal to or just slightly larger than the diameter of the plug at its widest point. The point on the latch where the plug enters the bore has a diameter that is slightly smaller than the diameter of the plug at its widest point. The clip material is resilient enough so that the plug can pass through this smaller opening and into the rest of the bore with a small amount of pressure.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1A:
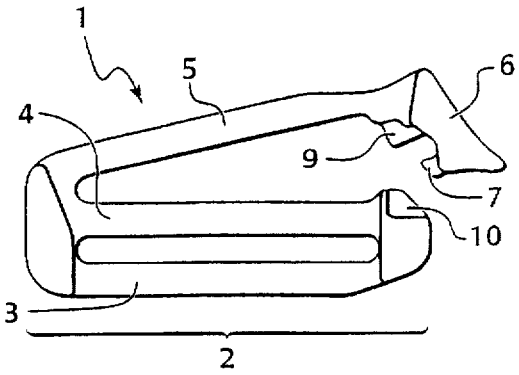
FIG. 1*a* is a side view of one embodiment of the present invention in the open position.

Referring now in detail to the drawings and, in particular, FIGS. 1*a*, 1*b*, 2*a*, 2*b* and 3, there is shown a clip 1, having a clip body 2 comprised of parallel, connected arms 3 and 4. Free arm 5 is attached at one end to clip body 2. Free arm 5 extends upwards at a slight angle from clip body 2, so that an opening is present between the end of free arm 5 and clip body 2 for inserting a hook or loop to be secured.

The other end of free arm 5 is attached to latch 6 having at its free end a tooth 7 extending generally parallel to free arm 5. Tooth 7 is preferably located on only one lateral side of latch 6. Latch 6 also has a downwardly extending protrusion 9 located between free arm 5 and tooth 7 and on the opposite lateral side from tooth 7.

Figure 1B:
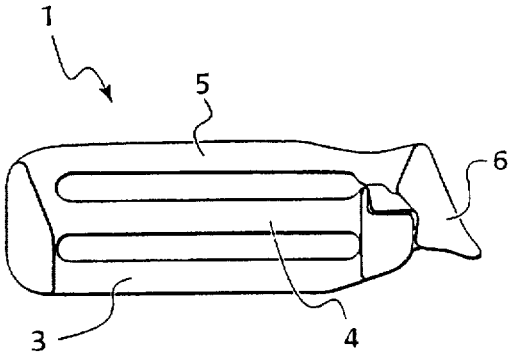
FIG. 1*b* is a side view of the embodiment of FIG. 1 in the closed position.
Figure 2A:
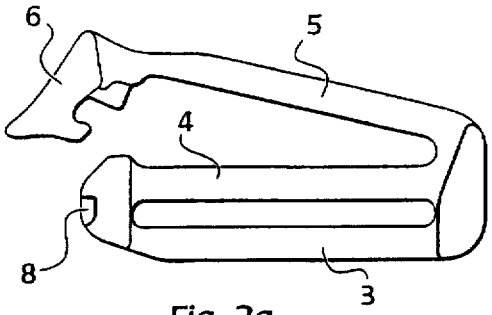
FIG. 2*a* is a view of the opposite side of the embodiment of FIG. 1*a*.
Figure 2B:
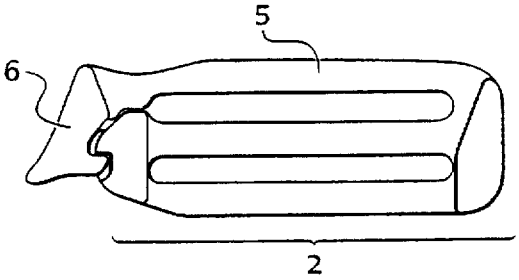
FIG. 2*b* is a view of the opposite side of the embodiment of FIG. 1*b*.
Figure 3:
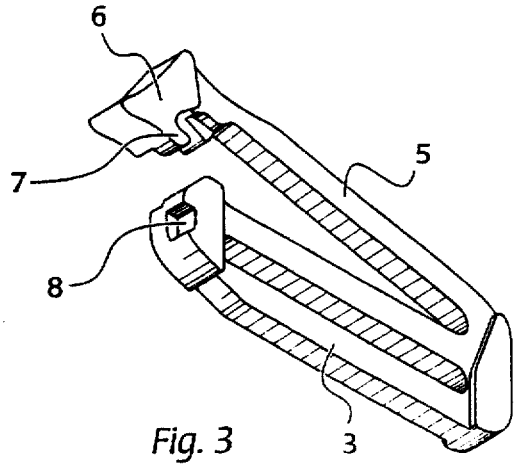
FIG. 3 is a perspective view of the embodiment of FIGS. 1 and 2.

As can be seen in FIG. 2*a*, the end of clip body 2 that is adjacent to the free end of free arm 5 contains a groove 8 on one lateral side for releasably engaging tooth 7. As free arm 5 is pressed downward toward clip body 2, tooth 7 becomes engaged in groove 8, as shown in FIG. 2*b*. At the same time, protrusion 9 comes to rest on indentation 10, located on the opposite lateral side of clip body 2 from groove 8, as shown in FIG. 1*b*. Protrusion 9 serves to prevent tooth 7 from becoming disengaged from groove 8 due to lateral pressure on free arm 5.

Upward pressure on free arm 5, such as caused by a strap pulling away from luggage to which clip 1 is attached, causes tooth 7 to press into groove 8 and become more tightly engaged in groove 8. Clip 1 is constructed to withstand stresses of up to 50 lbs. before releasing.

To release free arm 5, upward pressure with the user's thumb on latch 6 is all that is required. This upward pressure disengages tooth 7 from groove 8 and allows free arm 5 to return to its open position.

Figure 4:
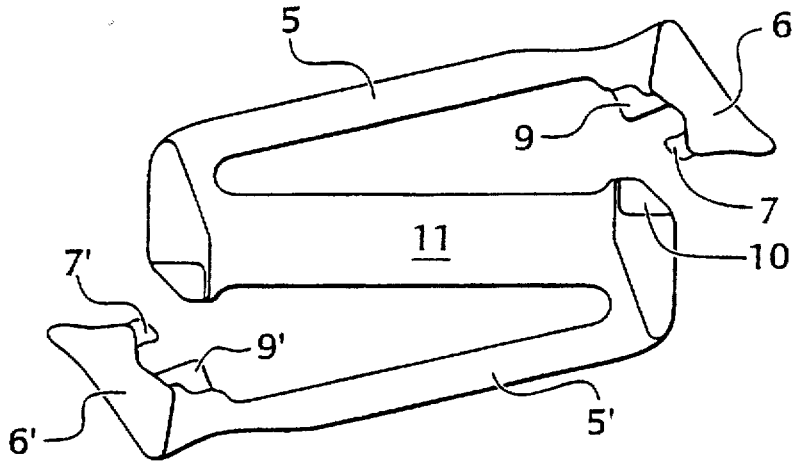
FIG. 4 is a side view of another embodiment of the present invention in the open position.
Figure 5A:
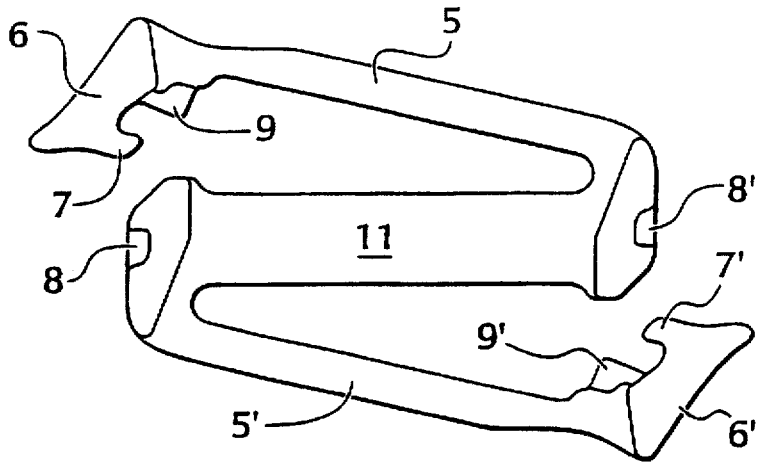
FIG. 5*a* is a side view of the opposite side of the embodiment of FIG. 4.
Figure 5B:
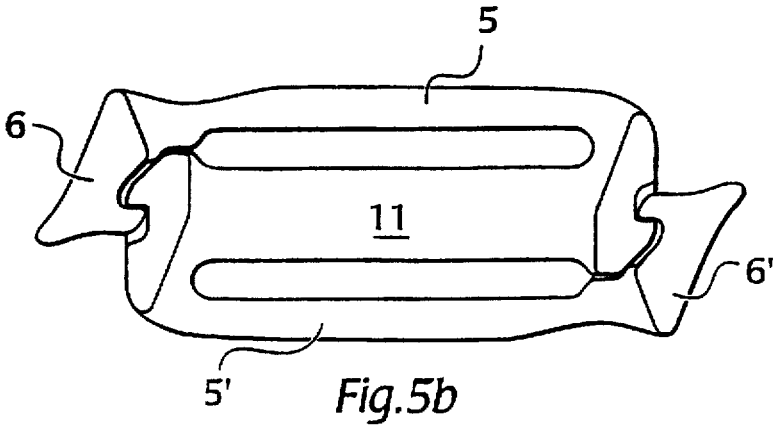
FIG. 5*b* is a side view of the embodiment of FIG. 5*a* in the closed position.
Figure 6A:
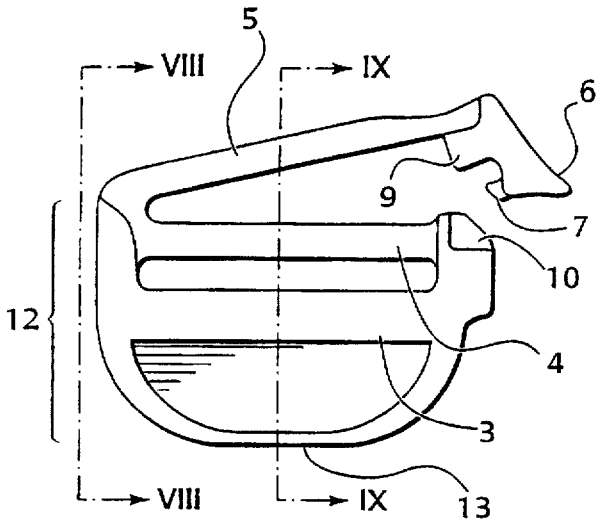
FIG. 6*a* is a side view of yet another embodiment of the present invention in the open position.
Figure 6B:
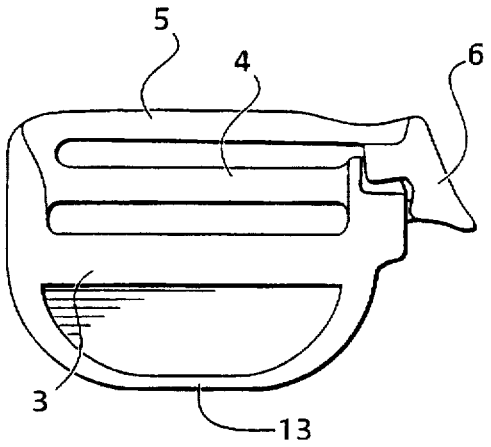
FIG. 6*b* is a side view of the embodiment of FIG. 6*a* in the closed position.
Figure 7:
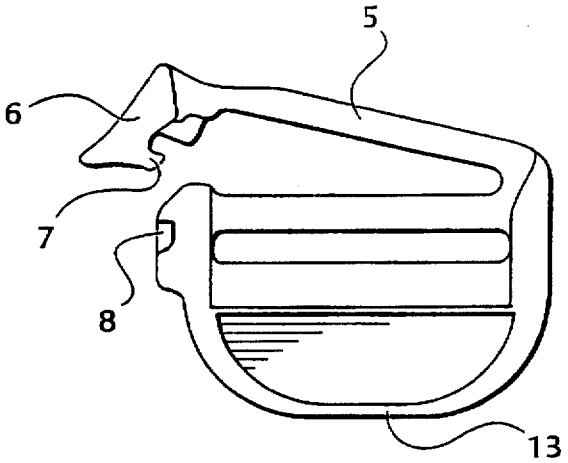
FIG. 7 is a side view of the opposite side of the embodiment of FIG. 6*a*.
Figure 8:
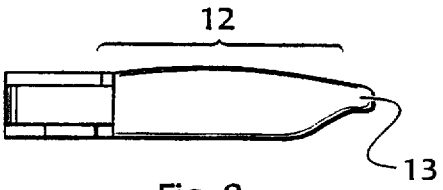
FIG. 8 is a view along lines XIII—XIII of the embodiment of FIG. 6*a*.

Another embodiment of the present invention is shown in FIGS. 4, 5*a* and 5*b*. In this embodiment, two free arms 5 and 5' form releasable clips on a single clip body 11. Arm 5 has a latch 6, a tooth 7 and a protrusion 9. Arm 5' has a latch 6' a tooth 7' and a protrusion 9'. The releasable locking of free arms 5 and 5' operates in the manner described above in connection with the embodiment of FIGS. 1–3. As shown in FIGS. 4, 5*a* and 5*b*, free arm 5 extends in a direction opposite the direction of free arm 5' so that the releasable locking of teeth 7 and 7' occur on opposite sides of clip body 11.

A third embodiment of the present invention is shown in FIGS. 6*a*, 6*b*, and 7–9. In this embodiment, clip body 12 includes a buckle means 13 attached below arm 3, to enable alternative means for securing the clip. A strap may be woven in among arms 3 and 4 and buckle means 13 for attaching the clip to luggage or backpacks. The releasable locking of free arm 5 operates in the same manner as described in connection with FIGS. 1–3.

Figure 9:
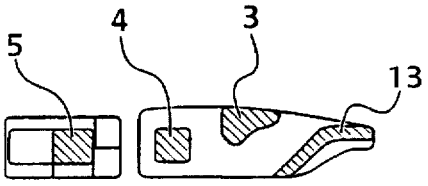
FIG. 9 is a cross-sectional view along lines IX—IX of the embodiment of FIG. 6*a*.

As shown in FIG. 9, arms 3 and 4 and buckle means 13 are placed in such a way that straps may be interwoven between the arms and buckle means in an efficient and secure manner. Buckle means 13 has an angled cross section to optimize the secure threading of straps through the clip body.

Figure 10:
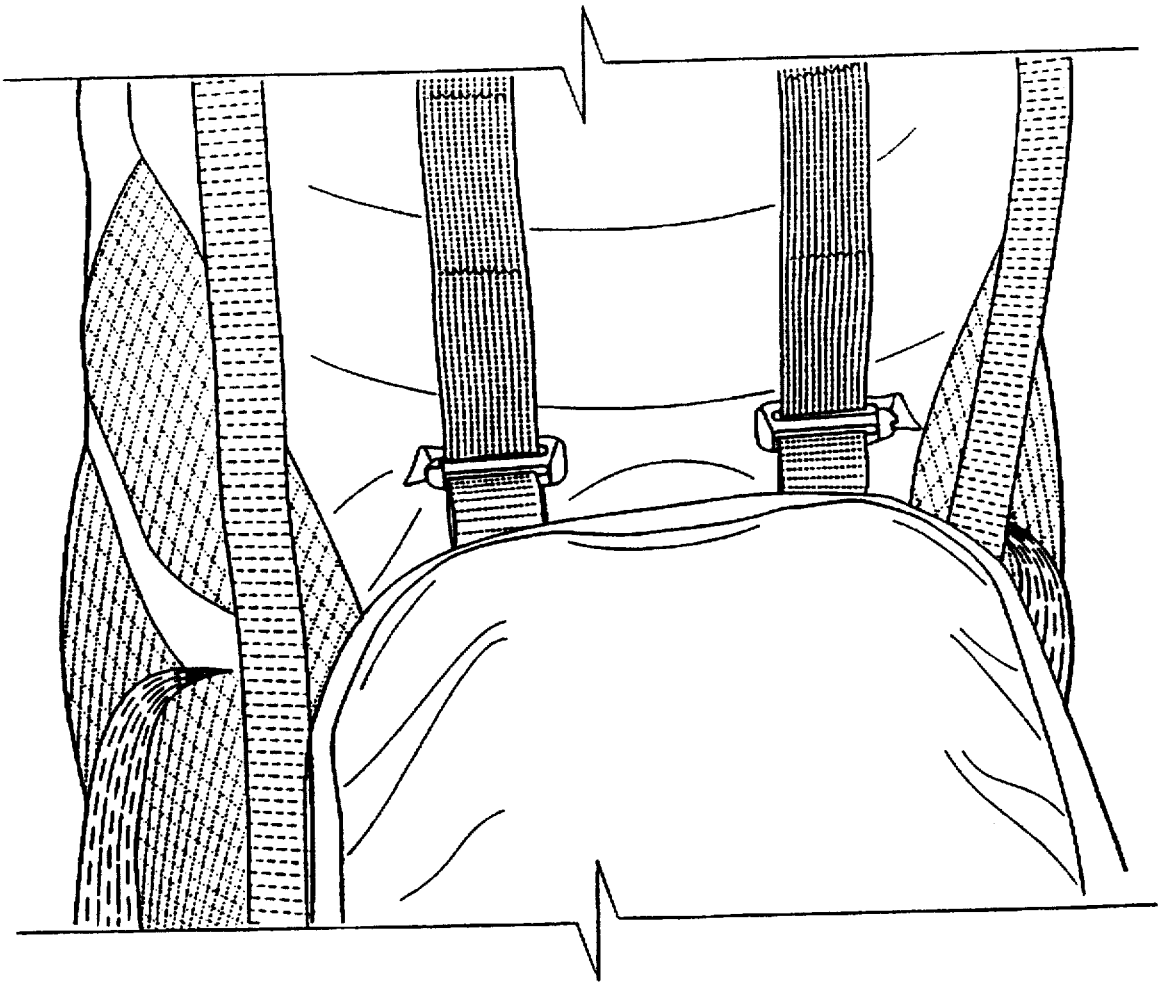
FIG. 10 is a perspective view of a backpack assembly showing the clip of FIG. 1 in use.
Figure 11:
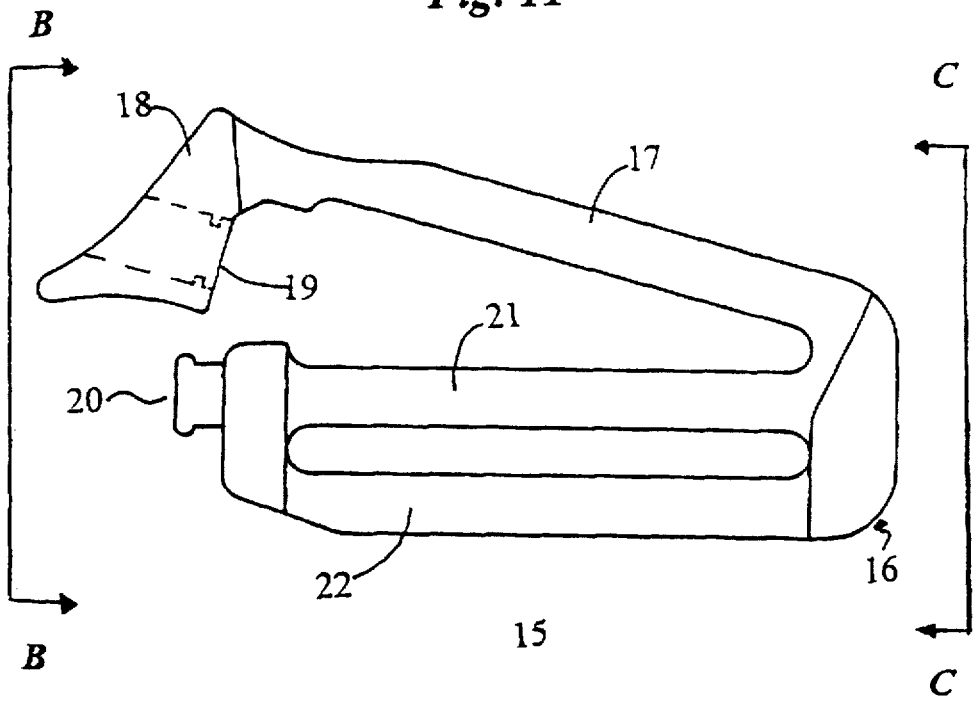
FIG. 11 is a side view of a fourth embodiment of the invention.
Figure 12:
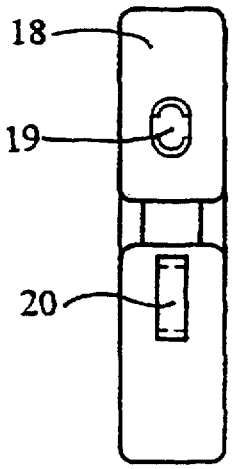
FIG. 12 is an end view along lines B—B of the embodiment of FIG. 11.
Figure 13:
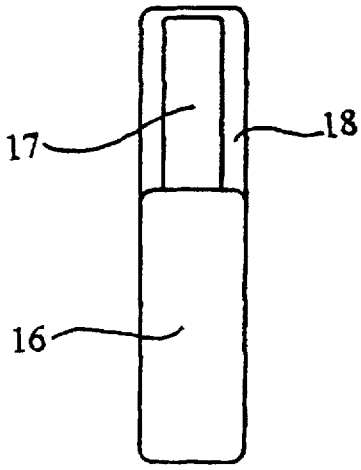
FIG. 13 is an end view along lines C—C of the embodiment of FIG. 11.
Figure 14:
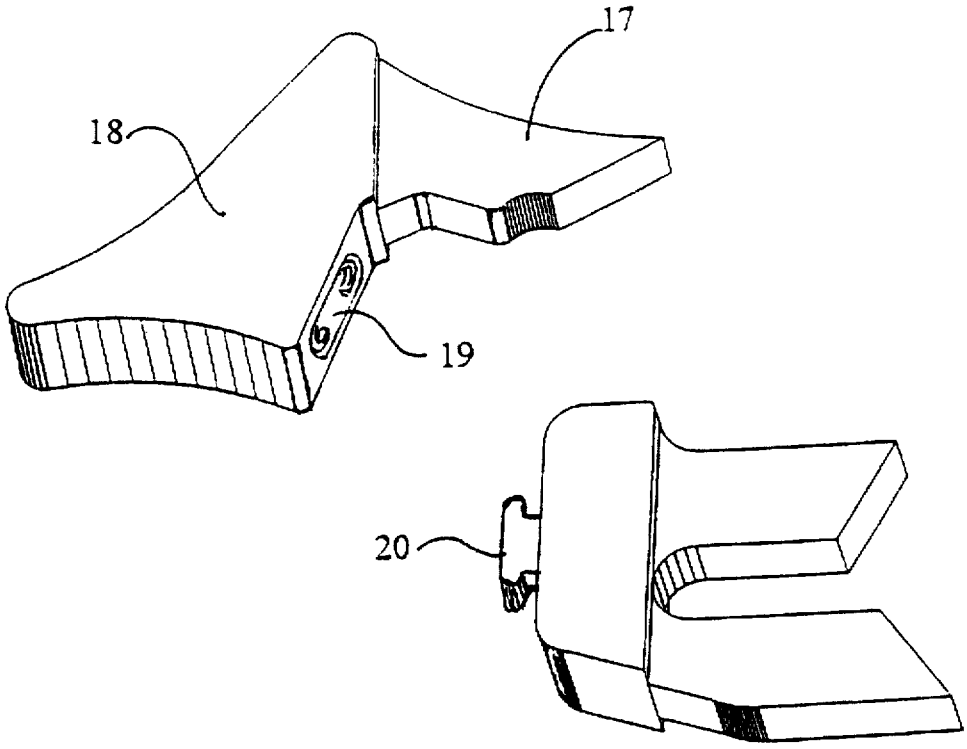
FIG. 14 is a perspective view of the latch and plug elements of the embodiment of FIG. 11.

As shown in FIG. 10, clip 1 may be used in a backpack assembly to releasably secure a smaller pack to a larger pack.

A fourth embodiment of the invention is shown in FIGS. 11–14. In this embodiment, clip 15 has a free arm 17 containing a latch 18 with a bore 19 running through it. Bore 19 extends through latch 18 so as to create both an external and an internal opening in latch 18. The diameter of bore 19 is smaller at the internal opening than throughout the rest of bore 19. Clip body 16 is made up of two spaced-apart parallel arms 21 and 22, which may be used to permanently secure clip 15 to a backpack. Clip body 16 has a plug 20 on the end nearest latch 18.

Downward pressure on free arm 17 causes plug 20 to insert into bore 19 at the internal opening on latch 18. The material of clip 15 is resilient enough so as to allow the widest end of plug 20 to pass through the narrowest point of bore 19, but is stiff enough to keep plug 20 securely fastened within bore 19 once plug 20 has been inserted. Upward pressure on free arm 17 causes plug 20 to be inserted even more securely into bore 19, up to a pressure of 50 pounds. Free arm 17 may be released by applying upward pressure on latch 18, which causes plug 20 to disengage from bore 19.

Accordingly, while only several embodiments of the present invention have been shown and described, it is obvious that many changes and modifications may be made thereunto without departing from the spirit and scope of the invention.

What is claimed is:

1. An integrally-formed clip for releasably securing objects, comprising:

a clip body having two planar sides, a top edge, a bottom edge, a first end and a second end and means for attaching the clip to a surface;

at least one free arm attached at a first end to the first end of the clip body at one of the top and bottom edges and having a second end, said free arm being positioned at an angle away from the clip body such as to create an opening between the second end of the free arm and the clip body, wherein the free arm pivots in a plane parallel to the planar sides of the clip body;

a latch disposed on the second end of the free arm, said latch having a free end and extending toward the clip body at an angle;

a tooth disposed on the free end of the latch, said tooth positioned generally parallel to the free arm; and at least one groove having dimensions substantially equal to those of the tooth and arranged on the end of the clip body nearest the second end of the free arm, such that downward pressure on the latch causes the tooth to be engaged by the groove and lock the second end of the free arm to the clip body, and upward pressure on the latch causes the tooth to become disengaged from the groove and release the second end of the free arm, and wherein upward pressure on the free arm while said free arm is in the locked position causes the tooth to be pressed into the groove with increasing force and lock the free arm more securely onto the clip body.

2. The clip according to claim 1, wherein the tooth and the groove have a width smaller than the width of the clip body.

3. The clip according to claim 1, further comprising a downwardly extending protrusion disposed on the latch between the free arm and the tooth, and an indentation having substantially the same dimensions as the protrusion and disposed on the end of the clip body nearest the second end of the free arm, such that the protrusion comes to rest in the indentation when the free arm is in the locked position and prevents lateral pressure on the free arm from releasing the tooth from the groove.

4. The clip according to claim 1, wherein the clip body comprises a plurality of spaced apart, parallel arms, and wherein each parallel arm is connected at both ends thereof to an adjacent parallel arm.

5. The clip according to claim 1, wherein there are two free arms, each free arm having a latch and a tooth, and further comprising two grooves for engaging the free arms, and wherein one of the two free arms is disposed at the top edge and the other of the two free arms is disposed at the bottom edge of the clip body.

6. The clip according to claim 5, wherein the free ends of the free arms extend in opposite directions from one another.

7. The clip according to claim 1, wherein the clip is made of acetal.

8. The clip according to claim 1, further comprising a buckle integrally formed with the clip body, so that the clip body can be slidably mounted onto a strap by threading the strap through the buckle.

9. An integrally-formed clip for releasably securing objects, comprising:

a clip body having two planar sides, a top edge, a bottom edge, a first end and a second end and means for attaching the clip to a surface;

at least one free arm attached at a first end to the first end of the clip body at one of the top and bottom edges and having a second end, said free arm being positioned at an angle away from the clip body such as to create an opening between the second end of the free arm and the clip body, wherein the free arm is adapted to pivot in a plane parallel to the planar sides of the clip body;

a latch disposed on the second end of the free arm, said latch having a free end and extending toward the clip body at an angle;

a bore extending through the free end of the latch, said bore positioned generally parallel to the free arm and having an external opening and an internal opening, wherein the diameter of the bore is smaller at the internal opening than the bore extending throughout the rest of the latch; and a plug arranged on the end of the clip body nearest the second end of the free arm, said plug having a base and a free end, and wherein the diameter of the plug is greater at the free end than at the base, such that downward pressure on the latch causes the plug to be engaged by the bore at its internal opening and lock the second end of the free arm to the clip body, and upward pressure on the latch causes the plug to become disengaged from the bore and release the second end of the free arm, and wherein upward pressure on the free arm while said free arm is in the locked position causes the plug to be pressed into the bore with increasing force and lock the free arm more securely onto the clip body.

10. The clip according to claim 9, wherein the clip body comprises a plurality of spaced apart, parallel arms, and wherein each parallel arm is connected at both ends thereof to an adjacent parallel arm.

* * * * *